US008532968B2

(12) United States Patent
Oury et al.

(10) Patent No.: US 8,532,968 B2
(45) Date of Patent: Sep. 10, 2013

(54) METHOD OF IMPROVING THE PRODUCTION OF A MATURE GAS OR OIL FIELD

(75) Inventors: Jean-Marc Oury, Paris (FR); Bruno Heintz, Paris (FR); Hugues de Saint Germain, Sainte-Foy-les-Lyon (FR); Rémi Daudin, Paris (FR); Benoit Desjardins, Le Plessis-Robinson (FR)

(73) Assignee: Foroil, Paris (FR)

( * ) Notice: Subject to any disclaimer, the term of this patent is extended or adjusted under 35 U.S.C. 154(b) by 516 days.

(21) Appl. No.: 12/816,915

(22) Filed: Jun. 16, 2010

(65) Prior Publication Data

US 2011/0313743 A1 Dec. 22, 2011

(51) Int. Cl.
*G06G 7/48* (2006.01)

(52) U.S. Cl.
USPC ..... 703/10

(58) Field of Classification Search
USPC ..... 703/2, 10; 166/305.1, 250.01, 369, 166/254.2; 299/14; 702/6, 13; 367/73; 306/50
See application file for complete search history.

(56) References Cited

U.S. PATENT DOCUMENTS 5,838,634 A * 11/1998 Jones et al. ..... 367/73
6,002,985 A * 12/1999 Stephenson ..... 702/13
2003/0080604 A1* 5/2003 Vinegar et al. ..... 299/14
2007/0027666 A1* 2/2007 Frankel ..... 703/10
2009/0132458 A1* 5/2009 Edwards et al. ..... 706/50
2009/0306947 A1* 12/2009 Davidson ..... 703/2
2010/0071897 A1* 3/2010 Liu et al. ..... 166/250.01
2010/0082254 A1* 4/2010 Benischek et al. ..... 702/6
2011/0088895 A1* 4/2011 Pop et al. ..... 166/254.2
2011/0162848 A1* 7/2011 Duffy et al. ..... 166/305.1
2011/0308811 A1* 12/2011 Ghayour et al. ..... 166/369

OTHER PUBLICATIONS

Printout from assignee's website published Jan. 14, 2010.

* cited by examiner

*Primary Examiner* — Kandasamy Thangavelu
(74) *Attorney, Agent, or Firm* — Cozen O'Connor

(57) ABSTRACT

A method of improving the production of a mature gas or oil field, the field comprising a plurality of existing wells, the method comprising the steps of providing a field simulator capable of predicting a production of the field in function of a given scenario, a scenario being a set of data comprising production parameters of the existing wells and, the case may be, location and production parameters of one or more new wells, determining drainage areas of the existing wells using the field simulator, determining locations of candidate new wells such that drainage areas of the candidate new wells, determined using the field simulator, do not overlap with the drainage areas of the existing wells, optimizing the value of a gain function which depends on the field production by determining a set of wells out of a plurality of sets of wells, which optimize the value of said gain function, each set of wells of said plurality of sets of wells comprising the existing wells and new wells selected among the candidate new wells.

11 Claims, 2 Drawing Sheets

METHOD OF IMPROVING THE PRODUCTION OF A MATURE GAS OR OIL FIELD

BACKGROUND OF THE INVENTION

1. Field of the Invention

The present invention relates to improving the production of a mature gas or oil field. More precisely, the present invention relates to the use of a field simulator for determining drill location for new wells and/or new injectors.

2. Description of the Related Art

Mature oil and gas fields, with many producers and a long production history, become increasingly complex to comprehend properly with each passing year. Usually, after several drilling campaigns, no obvious solution exists to mitigate their decline using affordable hardware technologies. Still, there is room for improvement of the production over a so-called "baseline" or "business as usual" behavior of an entire mature field.

Field simulators have been developed to model the behavior of a mature oil or natural gas field and to forecast an expected quantity produced in response to a given set of applied production parameters. A type of field simulator capable of predicting the production of a field, well by well, for a given scenario, in a relatively short amount of time (a few seconds) has recently emerged.

However, substantial variations can be envisaged on the way to drill additional wells such that billions of possible scenarios exist. So far no traditional analysis has been able to identify an optimum scenario reliably. In particular, using a traditional meshed field simulator to determine the production of the field for each of the possible scenarios, in order to select the best one, would require an excessive amount of calculation time.

SUMMARY OF THE INVENTION

The invention has been achieved in consideration of the above problems and an object is to provide a method of improving the production of a mature natural gas or oil field, which does not require an excessive amount of calculation time.

An object of the invention provides a method of improving the production of a mature gas or oil field. According to the present invention, the field comprises a plurality of existing wells, said method comprising:

providing a field simulator capable of predicting a production of said field, well by well, in function of a given scenario, a scenario being a set of data comprising production parameters of the existing wells and, the case may be, location and production parameters of one or more new wells, determining drainage areas of said existing wells using the field simulator, determining locations of candidate new wells such that drainage areas of said candidate new wells, determined using the field simulator, do not overlap with the drainage areas of the existing wells, optimizing the value of a gain function which depends on the field production by determining a set of wells out of a plurality of sets of wells, which optimizes the value of said gain function, each set of wells of said plurality of sets of wells comprising the existing wells and new wells selected among the candidate new wells.

With the method of the invention, the candidate new wells are determined such that their drainage areas do not overlap with the drainage areas of the existing wells. Thus, the number of candidate new wells is reduced in comparison to the multiple possible locations for new wells. Since the gain function depends on the field production, determination of its value for a given scenario requires using the field simulator. However, since optimization is carried out by selecting new wells among the candidate new wells, the number of scenarios is reduced in comparison to the number of possible scenarios. The optimization does not require using the field simulator for each of the possible scenarios and calculation time is reduced.

In an embodiment, the method comprises an heuristic step wherein candidate new wells are preselected or deselected by applying at least one heuristic rule, each set of wells of said plurality of sets of wells consisting of the existing wells and new wells selected among the preselected candidate new wells.

This allows reducing further the numbers of scenarios.

For instance, said heuristic rule comprises preselecting and deselecting candidate new horizontal wells, depending on their orientation.

Said heuristic rule may comprise preselecting and deselecting candidate new wells, depending on their distance with the existing wells.

The heuristic rule may also comprise preselecting and deselecting candidate new wells, depending on their cumulated oil production determined by the field simulator.

In an embodiment, optimizing the value of a gain function comprises determining the optimum production parameters for a given set of wells by applying deterministic optimization methods.

Optimizing the value of a gain function may comprise determining the optimum given set of wells by applying non-deterministic optimization methods.

In an embodiment, optimizing the value of said gain function comprises determining a set of injectors which optimize the value of said gain function.

The wells may have a single or multi-layered geology. In the later case, the field simulator may be capable of predicting a production of said field, well by well and by layer or group of layers.

The method may comprise a step of defining constraints to be fulfilled by the set of wells which optimizes the value of said gain function.

The method may comprise a step of defining constraints to be fulfilled by said optimum production parameters.

BRIEF DESCRIPTION OF THE DRAWINGS

These and other objects and features of the present invention will become clear from the following description of the preferred embodiments given with reference to the accompanying drawings, in which.

DETAILED DESCRIPTION OF THE PREFERRED EMBODIMENTS

Figure 1:
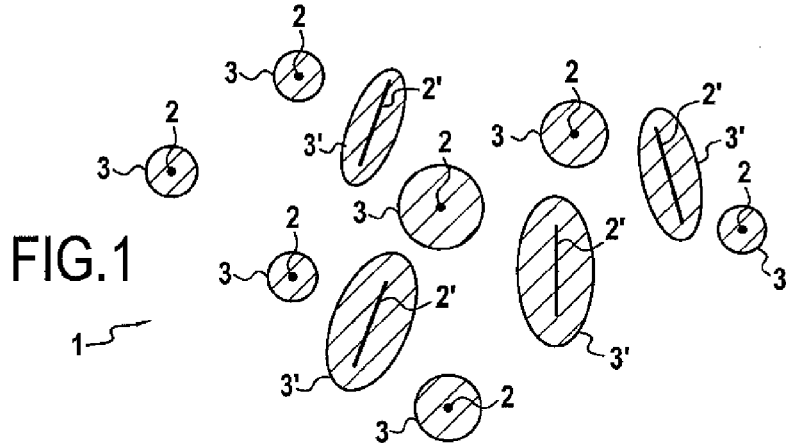
FIG. 1 is a schematic view showing the drainage areas of the existing wells of a mature oil field.

Embodiments of the invention will be described in detail herein below by referring to the drawings.

FIG. 1 represents a schematic view of a mature oil field 1, from above. The oil field 1 comprises a plurality of existing wells 2, 2'. The existing wells 2, 2' comprise in particular vertical wells 2 and horizontal wells 2'. In an embodiment, the oil field 1 may also comprise injectors.

The wells 2, 2' may have a single or multi-layered geology.

A field simulator is a computer program capable of predicting a production of the oil field 1 as a function of a given scenario. A scenario is a set of data comprising production parameters of the existing wells 2, 2' and, the case may be, location and production parameters of one or more new wells. In an embodiment, the scenario may also comprise production parameters of existing injectors and location and production parameters of new injectors.

More precisely, the filed simulator is capable of predicting the production of the oil field 1 well by well and, in case of a multi-layered geology, by layer or group of layers.

The production parameters may include, for instance, the Bottom Hole Flowing Pressures, well head pressure, gas lift rate, pump frequency, work-over, change of completion . . . . For the new wells, the production parameters may include the drilling time or completion.

As explained above, a type of field simulator capable of predicting the production of a field, well by well, and, as appropriate, layer by layer for a given scenario, in a relatively short amount of time has recently emerged. The skilled person is capable of providing such a field simulator for the oil field 1.

The present invention aims at improving the production of a mature natural gas or oil field. In the present embodiment, the production of oil field 1 is improved by identifying the place and timing where to drill new wells, and identifying which technology to use for each of the new wells (type of completion, vertical or horizontal, and if so which orientation). In another embodiment, the production of the oil field 1 may also be improved by identifying the location and timing where to drill new injectors.

Constraints can be defined, which need to be fulfilled by the production parameters $B_i$ or set of wells $\{W_i\}$. For instance, values to be given to future production parameters cannot deviate by more than ±20% than historical observed values, for existing and/or new wells. Likewise, the maximum number of new wells should be N, and not more than n wells can be drilled in a period of one year.

In this context, improving the production of oil field 1 means maximizing the value of a gain function, which depends on the field production, well by well and, as appropriate, layer by layer. For instance, the gain function may be the Net Present Value (NPV) of the field over five years.

For instance, a simplified approach is to compute the discounted value of the production and to subtract the investment (the cost of drilling new wells). In this case, for a given scenario, the gain function is:

$$NPV = NPV(\{W_i\}, B_i) = \sum_{j=1}^{5\,years} \sum_{i=1}^{n} P_i * \frac{S}{(1+d)^j} - \sum_{j=1}^{5\,years} \sum_{i=1}^{n} I_{i,j}$$

where:

$\{W_i\}$ is the set of wells for the scenario, comprising existing wells and new wells.

$B_i$ is the production parameter of the set of wells $\{W_i\}$.

$P_i$ denotes the oil production for well $W_i$ (calculated using the field simulator).

n is the number of wells in the set of wells $\{W_i\}$.

S denotes the net oil sale price after tax.

d denotes the discount rate.

$I_{i,j}$ denotes investment made on well $W_i$ during year j.

Maximizing the value of the gain function NPV implies identifying an optimum set of wells $\{W_i\}$ and corresponding production parameters $B_i$. For this purpose, the present invention uses a two-part approach. First, candidate new wells are determined. Then, optimization process is applied in order to select, among the existing wells and the candidate new wells, the set of wells $\{W_i\}$ which maximize the value of the gain function.

Figure 4:
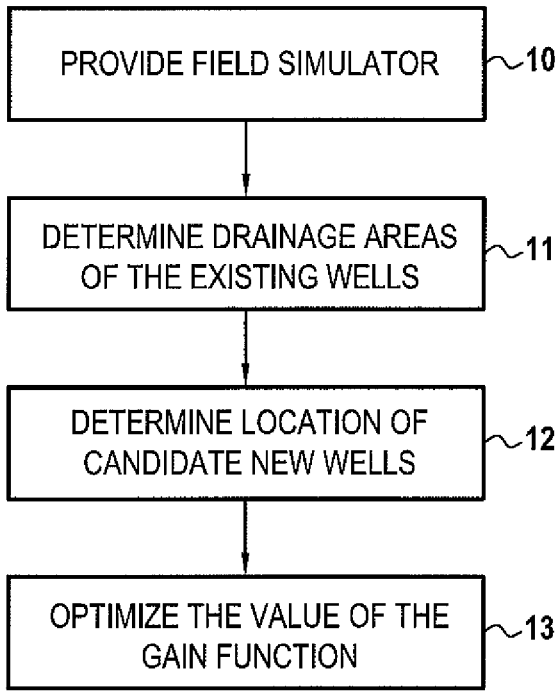
FIG. 4 is a flowchart illustrating a method for improving the production of a mature oil field, according to an embodiment of the invention.

A detailed description of this two-part approach is given below, with references to FIG. 4.

First, as explained above, a field simulator is provided in step 10.

For a given scenario that does not comprise new wells, the field simulator can predict the cumulated oil produced (COP) of each existing wells 2, 2', forwarded by a few years, for instance until five years in the future. This allows determining the drainage areas 3, 3' of the existing wells 2, 2', in step 11.

The calculation of the drainage area will be made in such a way it gives a good understanding of the field area, which has been substantially more produced than the average field.

For instance, assuming a thin production reservoir (thickness h small compared to the inter-well distance), a drainage area can be defined for any given existing well $W_i$, as the surface $S_i$ around it, such that:

$$(COP)_i = \Phi_i S_i h_i (1 - S_{wi} - S_{or})_i$$

where:

$(COP)_i$ is the cumulated oil produced by well $W_i$ forwarded by five years, predicted by the field simulator.

$\Phi_i$ is the average porosity around well $W_i$.

$S_{wi}$ is the irreducible water saturation.

$S_{or}$ is the residual oil saturation.

The shape of the surface $S_i$ depends on the field and on the well technology. In the example of oil field 1, the surface $S_i$ is a circle for vertical wells 2 and an ellipse with main axis given by the drain for horizontal wells 2'. FIG. 1 represents the drainage areas 3, 3' of the existing wells 2, 2'.

Once the drainage areas 3, 3' of the existing wells 2, 2' have been determined, the locations of candidate new wells may be determined in step 12, such that the drainage areas of the candidate new wells do not overlap with the drainage areas 3, 3' of the existing wells. More precisely, candidate new wells may be positioned on a plurality of maps as will now be explained.

Figure 2:
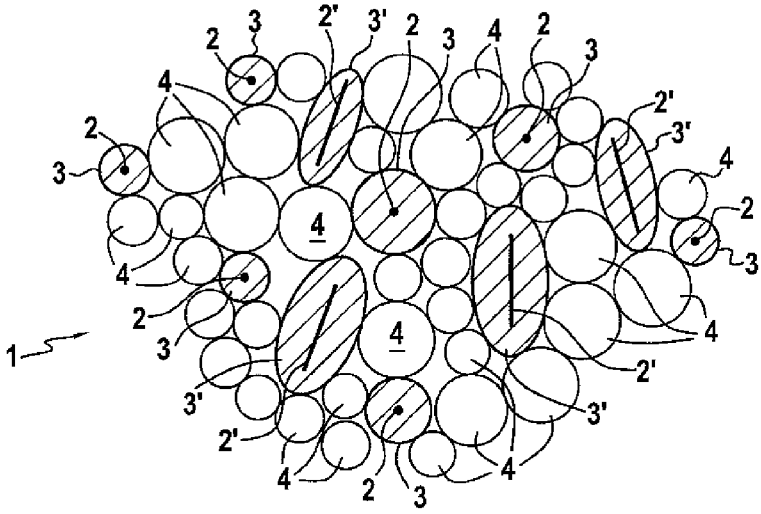
FIGS. 2 and 3 show the drainage areas of candidate new wells for the oil field of FIG. 1.

The free areas of FIG. 1 represent areas where new wells may be drilled. For a given new vertical well located in one of said free areas, a drainage area in the shape of a circle may be determined using the field simulator, in the same manner as above. Assuming that, in this particular case, all the new wells located in the same free area will have the same drainage area, a plurality of circles of the same size may be positioned in the free area, without overlapping with the drainage areas 3, 3' of the existing wells 2, 2'. FIG. 2 represent a plurality of circle 4 positioned as described above. The center of each circle 4 represents the location of a candidate new vertical well.

Figure 3:
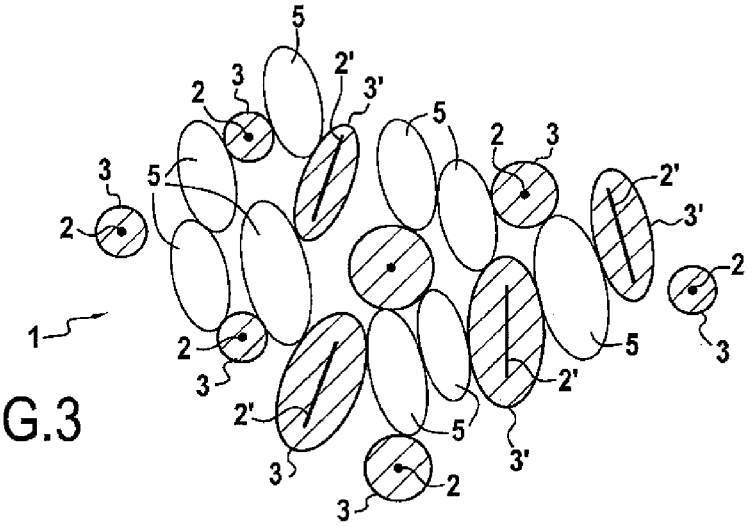

Similarly, for a given new horizontal well, a drainage area in the shape of an ellipse may be determined using the field simulator. A plurality of ellipses of the same size (or different sizes, as defined by the simulator), may be positioned in the free areas, without overlapping with the drainage areas 3, 3' of the existing wells 2, 2'. FIG. 3 represent a plurality of ellipse 5 positioned as described above, with their main axis oriented in the same direction. The main axis of each ellipse 5 represents the location of the drain of a candidate new horizontal well. Similar maps with ellipses oriented in different directions may be determined. For instance, eight maps of candidate horizontal wells are determined, with the main axis of their ellipses oriented 15° from each other.

Thus, the location of a plurality of candidate new wells, vertical and horizontal, has been determined. Then, in step 13, as explained before, optimization process is applied in order to select, among the existing wells and the candidate new wells, the set of wells $\{W_i\}$ which maximizes the value of the gain function.

More precisely, the optimization processing uses heuristic approaches, deterministic convergence and non-deterministic convergence.

The heuristic approaches aim at reducing the number of candidate new wells by preselecting new wells and deselecting others. The following rules may be applied:

- Candidate new wells are ranked according to their cumulated oil production (determined by the field simulator for determining the drainage areas as described above) and only the first ones are preselected, for instance the 50% first ones. This allows keeping a sufficient large number of wells, as potential interactions between wells might modify the ranking of wells, as compared to the initial above-mentioned ranking, where new wells are supposed to produce alone, that is with no other competing new well.
- Horizontal well orientation takes into account general geology preferential direction. Candidate new horizontal wells are preselected or deselected according to the differences between their orientation and the geology preferential direction. For instance, candidate new horizontal wells are preselected if the difference between their orientation and the geology preferential direction does not exceed 15°. The other candidate new horizontal wells are deselected.
- Candidate new horizontal wells are deselected if they approach one of the existing wells 2, 2' of more than, for instance, 0.1 times the inter-well distance.

The deterministic convergence aims at determining the optimum production parameters $B_{i0}$ for a given set of wells $\{W_i\}$. Since the production parameters are mainly continuous parameters, classical optimization methods (deterministic and non-deterministic) may be used, such as gradient or pseudo-gradient methods, branch and cut methods . . . .

The non-deterministic convergence aims at finding the set of wells $\{W_i\}$ maximizing the gain function NPV. As sets of wells $\{W_i\}$ are discrete, non-deterministic methods are applied, together with the heuristic rules described above. They allow selecting appropriate sets of wells, in order to extensively explore the space of good candidates and identify the optimum set of wells $\{W_i\}_0$, comprising existing wells 2, 2' and new wells with their location, technology (vertical/horizontal with orientation), and drilling date. Such methods may include simulated annealing or evolutionary methods, for instance.

Such non-deterministic method needs to calculate the gain function, under given constraints, by using the field simulator, for a large number of sets of wells. However, since the sets of wells comprises the existing wells and new wells selected among the preselected candidate new wells, the number of possible sets of wells is limited in comparison with the billions of possible scenarios. For instance, in one embodiment, the gain function is calculated for hundreds of thousands of sets of wells. However, the calculation time needed is small in comparison with the calculation time that would be needed for calculating the gain function for the billions of possible scenarios. In other words, the present invention allows identifying an optimum set of wells $\{W_i\}_0$ in a limited time.

In addition to the optimum set of wells $\{W_i\}_0$ and corresponding optimum parameters $B_{i0}$ of the optimum scenario, other good, sub-optima scenarios may be identified, which deliver a gain function value close to the optimum (typically less than 10% below optimum, as a proportion of the difference between the value of the gain function for a reference scenario and the value of the gain function for the optimum scenario, both complying with the same constraints). In an embodiment, instead of drilling the new wells of the optimum scenario, sub-optimal scenarios are selected as described below in order to drill new wells.

The optimum scenario depends on constraints and input parameters (called "external parameters"), for instance the price of oil. For certain variations of such external parameters, the number of new wells identified in the optimum set of wells $\{W_i\}_0$ will increase or decrease. For instance, an increased price of oil will trigger additional new wells, as more will become economic.

In order to be as much as possible insensitive to variation of such external parameters, good sub-optimal scenarios will be selected in such a way the number of their common new wells is as large as possible. This is to make sure that a variation of external parameters will not completely change the list of new wells, therefore making new drills obsolete.

Ideally, for a sequence of increasing oil price $S_1, S_2, \ldots S_n$, the corresponding sets of wells $\{W_i\}_1, \{W_i\}_2 \ldots \{W_i\}_n$ for good sub-optimal scenarios will be such that $\{W_i\}_1 \subset \{W_i\}_2 \subset \ldots \subset \{W_i\}_n$. Otherwise, the sum of the cardinal of common new wells should be maximum.

For instance, let assume the following results have been obtained:

For $S_1$=50 USD, $\{W_i\}_1$={existing wells, W1, W2'}.

For $S_2$=65 USD, $\{W_i\}_2$={existing wells, W1, W2, W3}.

For $S_3$=80 USD, $\{W_i\}_3$={existing wells, W1, W2', W4, W3}.

where, W1, W2, W2', W3, W4 are new wells for the respective scenarios, and the drainage areas of W2 and W4 overlap. If wells W1, W2 and W3 are drilled, and later the price of oil increase to 80 USD, well W4 will be in conflict with well W2.

Therefore, what-if simulations are carried out, in order to calculate the NPV of various sub-optimal scenarios and identify the one which will allow drilling good additional wells in case the price of oil increases. For instance, in the previous example, for $S_2$=65 USD, the scenario with the set of wells $\{W_i\}_2'$={existing wells, W1, W2', W3} may be sub-optimal with a gain function less than 5% below the optimum. Therefore, it is reasonable to drill new wells W1, W2', W3. If later the price of oil increases to 80 USD, new wells W4 may be drilled without conflicting with well W2'.

What is claimed is:

1. A method of improving production of a mature gas or oil field, said field comprising a plurality of existing wells, said method comprising:

(a) providing a field simulator capable of predicting a production of said field, well by well, in function of a given scenario, a scenario being a set of data comprising production parameters of the existing wells and, the case may be, location and production parameters of one or more new wells, (b) determining drainage areas of said existing wells using the field simulator, determining locations of candidate new wells, each set of wells comprising the existing wells and new wells selected amongst the candidate new wells, (c) determining locations of candidate new wells such that drainage areas of said candidate new wells, determined using the field simulator, do not overlap with the drainage areas of the existing wells, (d) determining a plurality of sets of wells, each set of wells comprising the existing wells and new wells selected amongst the candidate new wells, (e) determining for each set of wells, the value of a gain function, which depends on the field production, (f) selecting the set of wells that optimizes the value of the gain function, and (g) drilling the set of wells so selected.

2. The method according to claim 1, comprising an heuristic step wherein candidate new wells are preselected or deselected by applying at least one heuristic rule, each set of wells of said plurality of sets of wells consisting of the existing wells and new wells selected among the preselected candidate new wells.

3. The method according to claim 2, wherein said heuristic rule comprises preselecting and deselecting candidate new horizontal wells, depending on their orientation.

4. The method according to claim 2, wherein said heuristic rule comprises preselecting and deselecting candidate new wells, depending on their distance with the existing wells.

5. The method according to claim 2, wherein said heuristic rule comprises preselecting and deselecting candidate new wells, depending on their cumulated oil production determine by the field simulator.

6. The method according to claim 1, wherein optimizing the value of a gain function comprises determining the optimum production parameters for a given set of wells by applying deterministic or non deterministic optimization methods.

7. The method according to claim 6, comprising the step of defining constraints to be fulfilled by said optimum production parameters.

8. The method according to claim 1, wherein optimizing the value of a gain function comprises determining the optimum given set of wells by applying non deterministic optimization methods.

9. The method according to claim 1, wherein optimizing the value of said gain function comprises determining a set of injectors which optimize the value of said gain function.

10. The method according to claim 1, wherein at least one of the wells has a multi layered geology, and the field simulator is capable of predicting a production of said field, well by well and by layer or groups of layers.

11. The method according to claim 1, comprising the step or defining constraints to be fulfilled by the set of wells which optimizes the value of said gain function.

* * * * *